US010935035B2

(12) United States Patent
Pelton et al.

(10) Patent No.: US 10,935,035 B2
(45) Date of Patent: Mar. 2, 2021

(54) CLOSED IMPELLER WITH SELF-RECIRCULATION CASING TREATMENT

(71) Applicant: HANWHA POWERSYSTEMS CO., LTD, Changwon-si (KR)

(72) Inventors: Robert Pelton, Houston, TX (US); Se Woong Jung, Houston, TX (US)

(73) Assignee: HANWHA POWER SYSTEMS CO., LTD, Changwon-si (KR)

( * ) Notice: Subject to any disclaimer, the term of this patent is extended or adjusted under 35 U.S.C. 154(b) by 97 days.

(21) Appl. No.: 15/794,113

(22) Filed: Oct. 26, 2017

(65) Prior Publication Data

US 2019/0128270 A1 May 2, 2019

(51) Int. Cl.

| | |
|---|---|
| ***F04D 27/00*** | (2006.01) |
| ***F04D 29/28*** | (2006.01) |
| ***F04D 29/68*** | (2006.01) |
| ***F04D 29/42*** | (2006.01) |
| ***F04D 29/44*** | (2006.01) |
| ***F04D 29/62*** | (2006.01) |
| *F04D 29/30* | (2006.01) |
| *F04D 17/10* | (2006.01) |

(52) U.S. Cl.

CPC ..... *F04D 27/009* (2013.01); *F04D 29/284* (2013.01); *F04D 29/4213* (2013.01); *F04D 29/441* (2013.01); *F04D 29/624* (2013.01); *F04D 29/681* (2013.01); *F04D 29/685* (2013.01); *F04D 17/10* (2013.01); *F04D 29/30* (2013.01); *F04D 29/4206* (2013.01)

(58) Field of Classification Search

CPC ..... F04D 27/009; F04D 29/284; F04D 17/10; F04D 29/30; F04D 29/4206

USPC ..... 415/58.4

See application file for complete search history.

(56) References Cited

U.S. PATENT DOCUMENTS

| | | | | |
|---|---|---|---|---|
| 4,743,161 | A * | 5/1988 | Fisher | F04D 29/4213 415/116 |
| 5,333,990 | A * | 8/1994 | Foerster | F04D 29/4213 415/58.4 |
| 6,447,241 | B2 * | 9/2002 | Nakao | F04D 29/4213 415/1 |
| 7,475,539 | B2 * | 1/2009 | Chen | F04D 29/4213 415/144 |

(Continued)

FOREIGN PATENT DOCUMENTS

| | | |
|---|---|---|
| EP | 2 899 407 A1 | 7/2015 |
| JP | 2003-13895 A | 1/2003 |

(Continued)

*Primary Examiner* — Nathaniel E Wiehe
*Assistant Examiner* — Brian O Peters
(74) *Attorney, Agent, or Firm* — Sughrue Mion, PLLC

(57) ABSTRACT

A closed impeller includes: a housing provided with an opening; an insert inserted into one side of the opening; and an impeller body inserted into the other side of the opening, and including a plurality of blades and a shroud covering the plurality of blades, wherein the insert is provided with an inflow channel guiding a fluid into an inlet of the impeller body, and wherein a clearance between an outer surface of the insert and an inner surface of the housing forms a circulation flow channel connecting the other end of the inflow channel with a portion where one end of the inflow channel meets the inlet of the impeller body.

18 Claims, 9 Drawing Sheets

(56) References Cited

U.S. PATENT DOCUMENTS

| | | | | |
|---|---|---|---|---|
| 8,272,832 | B2 * | 9/2012 | Yin | F04D 29/444 415/191 |
| 8,287,233 | B2 * | 10/2012 | Chen | F04D 27/0207 415/151 |
| 8,454,299 | B2 * | 6/2013 | Higashimori | F04D 29/4213 415/206 |
| 8,465,251 | B2 * | 6/2013 | Hosoya | F04D 29/4213 415/119 |
| 8,690,524 | B2 * | 4/2014 | Yin | F04D 29/4213 415/119 |
| 8,888,440 | B2 * | 11/2014 | Tomita | F04D 29/4213 415/57.1 |
| 9,377,030 | B2 | 6/2016 | Maywey et al. | |
| 10,125,793 | B2 * | 11/2018 | Tomita | F04D 29/4213 |
| 2006/0198727 | A1 * | 9/2006 | Arnold | F02C 6/12 415/169.1 |
| 2015/0337863 | A1 * | 11/2015 | Tomita | F04D 29/4213 415/58.4 |
| 2016/0108920 | A1 * | 4/2016 | Yamashita | F04D 17/10 415/204 |
| 2016/0195109 | A1 * | 7/2016 | Richards | F04D 29/266 60/602 |
| 2016/0201693 | A1 * | 7/2016 | An | F04D 29/4213 415/58.4 |
| 2017/0260987 | A1 * | 9/2017 | Onodera | F04D 27/0215 |
| 2018/0328379 | A1 * | 11/2018 | Harris | F02B 37/16 |

FOREIGN PATENT DOCUMENTS

| | | | |
|---|---|---|---|
| JP | 2005-23792 | A | 1/2005 |
| JP | 2010-48147 | A | 3/2010 |
| JP | 4946396 | B2 | 6/2012 |

* cited by examiner

2

CLOSED IMPELLER WITH SELF-RECIRCULATION CASING TREATMENT

STATEMENT REGARDING FEDERAL RIGHTS

This invention was made with government support under Contract No DEEE0007114 awarded by the U.S. Department Of Energy. The government has certain rights in the invention.

BACKGROUND

1. Field

Apparatuses and methods consistent with the exemplary embodiments of the inventive concept relate to a centrifugal impeller, and, more particularly, to a closed impeller provided with a self-recirculation casing.

2. Description of the Related Art

A centrifugal compressor is an apparatus that compresses a fluid by applying a centrifugal force to the fluid using a rotating impeller.

The centrifugal compressor generally includes a drive unit producing a driving rotational force. This rotation is then transmitted to the impeller either directly or through a gear unit, and the impeller connected to the rotation shaft transfers kinetic energy to the fluid so as to increase the pressure of the fluid. The fluid then passes into a diffuser before entering a collector element such as a scroll. A shroud is connected with the scroll to form an inner space through which the fluid flows.

The operating range of the compressor is limited by choke at high flow rates and is limited by stall under a low flow rate condition. When stall occurs, aerodynamic instabilities develop, which affects the performance of the compressor. Further reducing the flow rate beyond the stall limit will lead to increased instabilities and an eventual surge of the compressor where large fluctuations in flow combined with dynamics of the impeller may lead to breakage of the impeller. Therefore, operation of the compressor should be limited to prevent operation in stall and potential damage to the compressor and connected equipment. Various attempts have been made to expand the available operation range of compressor stages. The onset of stall is characterized by regions of separated flow in the compressor flow passage. These stall regions may develop at various locations in a stage including an inlet or outlet of the impeller or diffuser. In cases of impeller inlet stall, a casing treatment can be an effective method to increase the stall limit of the stage. Generally, a casing treatment uses a method of isolating the low momentum region of flow from a main flow channel and delaying the onset of stall in the main flow channel. Most casing treatments require access to the flow channel through a fixed shroud, so they may be applied only to an opened impeller. However, various industrial compression applications utilize a closed impeller with an integral shroud, and still require a wide operation range.

SUMMARY

Various aspects of the inventive concept provide exemplary embodiments of a closed impeller capable of interfacing with a self-recirculating casing treatment.

However, these aspects are not restricted to the one set forth herein. The above and other aspects will become more apparent to one of ordinary skill in the art to which the exemplary embodiments pertain by referencing the detailed description given below.

According to an exemplary embodiment, there is provided a closed impeller stage which may include: a housing provided with an opening; an insert inserted into one side of the opening; and an impeller body inserted into the other side of the opening, and including a plurality of blades and a shroud covering the plurality of blades, wherein the insert is provided with an inflow channel guiding a fluid into an inlet of the impeller body, and wherein a clearance between an outer surface of the insert and an inner surface of the housing forms a circulation flow channel connecting the other end of the inflow channel with a portion where one end of the inflow channel meets the inlet of the impeller body.

The circulation flow channel may include: an outflow channel receiving a fluid discharged from the inlet of the impeller body, a hollow connected with the outflow channel to pass the fluid and a reflow channel of which one end is connected with the hollow and the other end is connected with the other end of the inflow channel so as to introduce the fluid into the inflow channel.

The insert may include a plurality of vanes formed in the hollow.

The plurality of vanes may be formed in a camber structure which is bent toward a radial direction of the insert along an outer circumferential direction of the insert.

The plurality of vanes may be arranged at regular intervals along the circumferential direction of the insert.

The plurality of vanes may be disposed to remove a swirl of the fluid passing through the circulation flow channel.

The plurality of vanes may extend in a direction parallel to a rotation axis of the impeller.

The outflow channel may have a width which is wider from the inlet of the impeller body toward the hollow.

The width of the hollow may be greater than the width of the outflow channel.

The reflow channel may extend along the radial direction of the insert.

The hollow may be formed in a shape of a toric body surrounding the outer circumference of the insert.

A part of the insert forming the outflow channel and a part of the housing may bee formed such that at least one of a diameter of the insert and a diameter of the housing becomes smaller as the insert and the housing approach the inlet of the impeller body.

When a flow rate of the fluid guided into the inflow channel is low, a part of the fluid is discharged from a region adjacent to the inlet of the impeller body to the outflow channel, is circulated through the hollow and the reflow channel, and is introduced into the inflow channel.

When the flow rate of the fluid guided into the inflow channel is high, a part of the fluid is discharged to the reflow channel, is bypassed through the hollow and the outflow channel, and is introduced into a region adjacent to the inlet of the impeller body.

The outer surface of the insert forming the circulation flow channel may have a curved edge.

The inflow channel may be formed at a center of the insert in an annular or circular shape.

The plurality of vanes may extend in a direction oblique to the rotation axis of the impeller.

The insert may have a plurality of cavities formed in a radial direction of the insert so as to connect the hollow and the inflow channel.

BRIEF DESCRIPTION OF THE DRAWINGS

The above and other aspects and features will become more apparent by describing in detail exemplary embodiments thereof with reference to the attached drawings, in which.

DETAILED DESCRIPTION OF THE EXEMPLARY EMBODIMENTS

Figure 1:
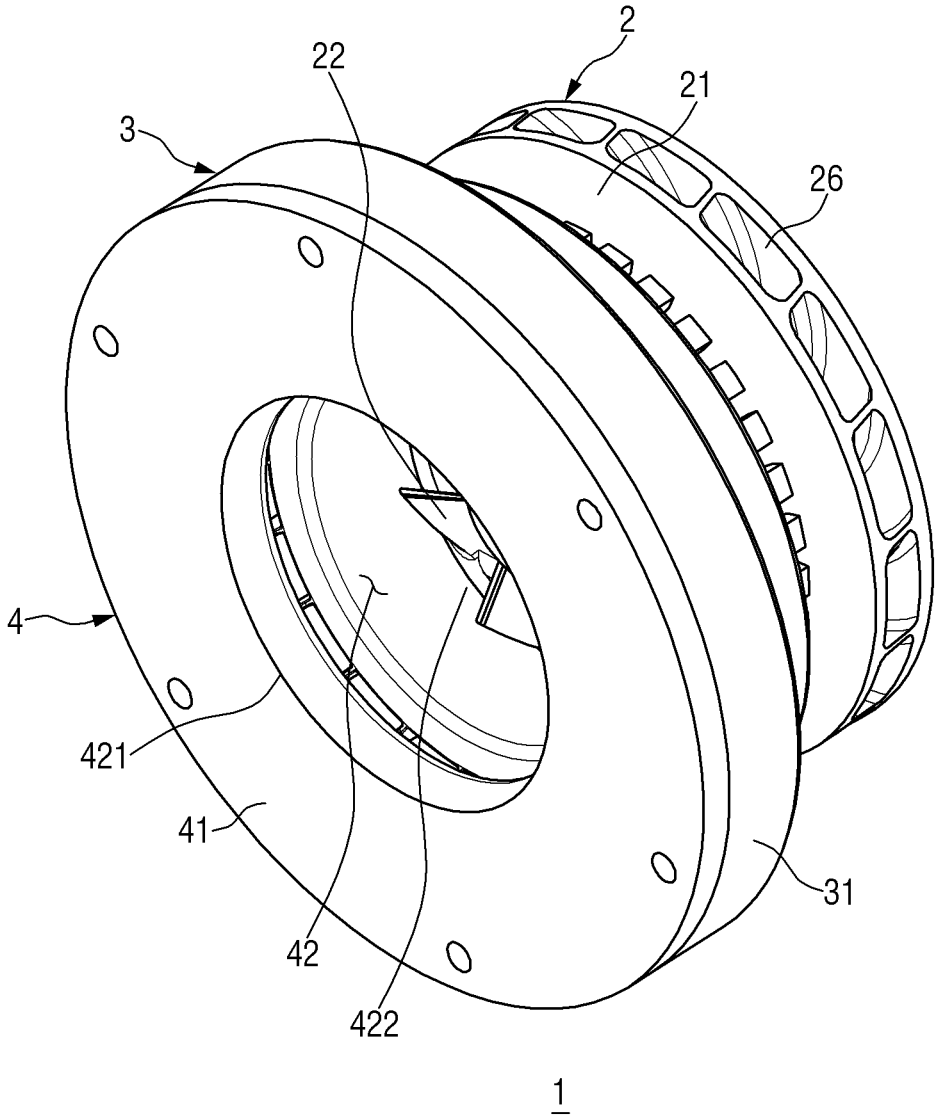
FIG. 1 is a perspective view of an impeller according to an exemplary embodiment.

Exemplary embodiments of the inventive concept will now be described more fully hereinafter with reference to the accompanying drawings. The inventive concept may, however, be embodied in different forms and should not be construed as limited to the exemplary embodiments set forth herein. Rather, these exemplary embodiments are provided so that this disclosure will be thorough and complete, and will fully convey the scope of the inventive concept to those skilled in the art. The same reference numbers indicate the same components throughout the specification. In the attached drawings, the thickness of layers and regions is exaggerated for clarity.

Unless defined otherwise, all technical and scientific terms used herein have the same meaning as commonly understood by one of ordinary skill in the art to which the exemplary embodiments belongs. It is noted that the use of any and all examples, or exemplary terms provided herein is intended merely to better illuminate the exemplary embodiments, and is not a limitation on the scope of the inventive concept unless otherwise specified. Further, unless defined otherwise, all terms defined in generally used dictionaries may not be overly interpreted.

The use of the terms "a" and "an" and "the" and similar referents in the context of describing the inventive concept (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Further, the exemplary embodiments described herein will be described with reference to cross-sectional views and/or schematic drawings that are ideal exemplary figures of the same. Thus, the shape of the exemplary figures can be modified by manufacturing techniques and/or tolerances. Further, in the drawings, each component may be somewhat enlarged or reduced in view of convenience of explanation. Reference numerals refer to same elements throughout the specification, and "and/or" include each and every combination of one or more of the mentioned items.

Spatially relative terms should be understood to be terms that include different orientations of components during use or operation in addition to those shown in the drawings. The components can also be oriented in different directions, so that spatially relative terms can be interpreted according to orientation.

The exemplary embodiments of the present disclosure will hereinafter be described with reference to the accompanying drawings.

Figure 2:
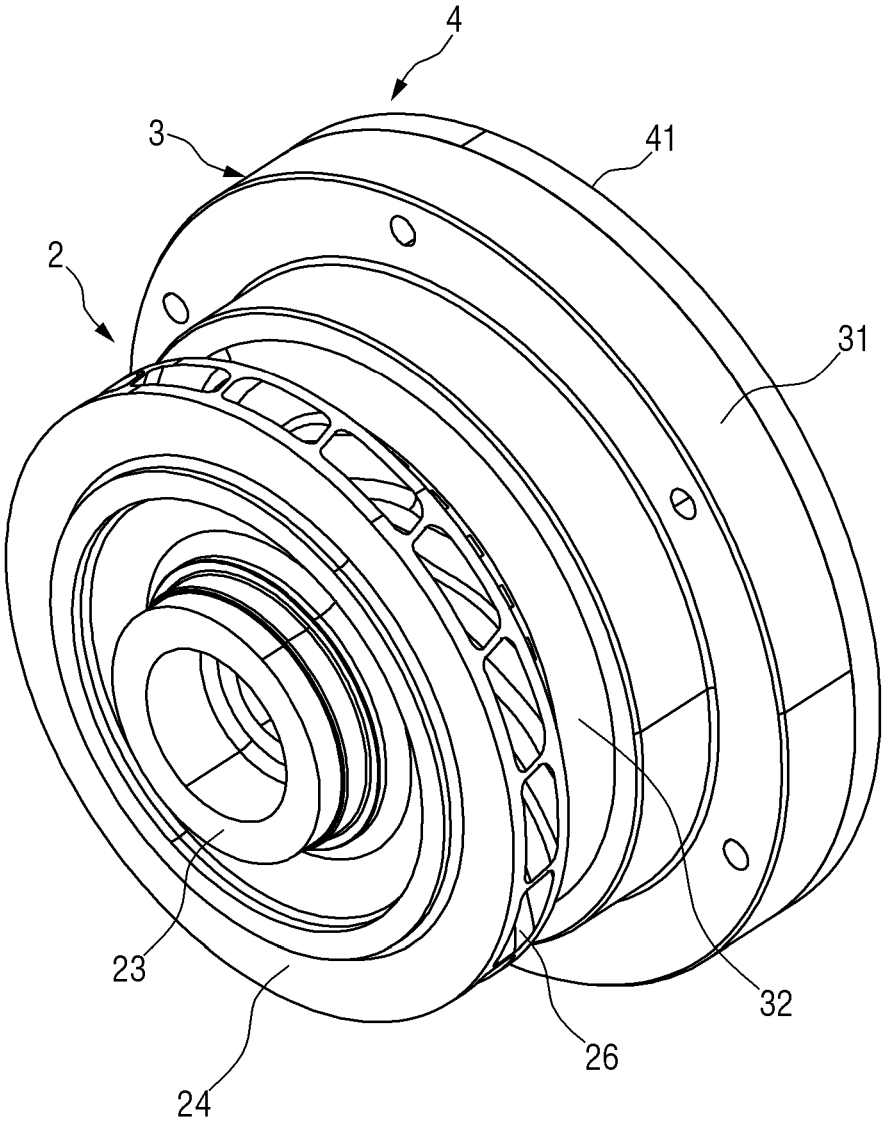
FIG. 2 is a perspective view the impeller of FIG. 1 seen in another direction according to an exemplary embodiment.

FIG. 1 is a perspective view of an impeller 1 according to an exemplary embodiment. FIG. 2 is a perspective view the impeller 1 seen in another direction according to an exemplary embodiment.

Referring to FIGS. 1 to 2, the impeller 1 according to the exemplary embodiments may include a housing 3, an insert 4, and an impeller body 2. According to an exemplary embodiment, the insert 4 can be a separate body to form a circulation flow channel. However, a circulation flow channel can be formed by machining or casting into a casing.

Figure 3:
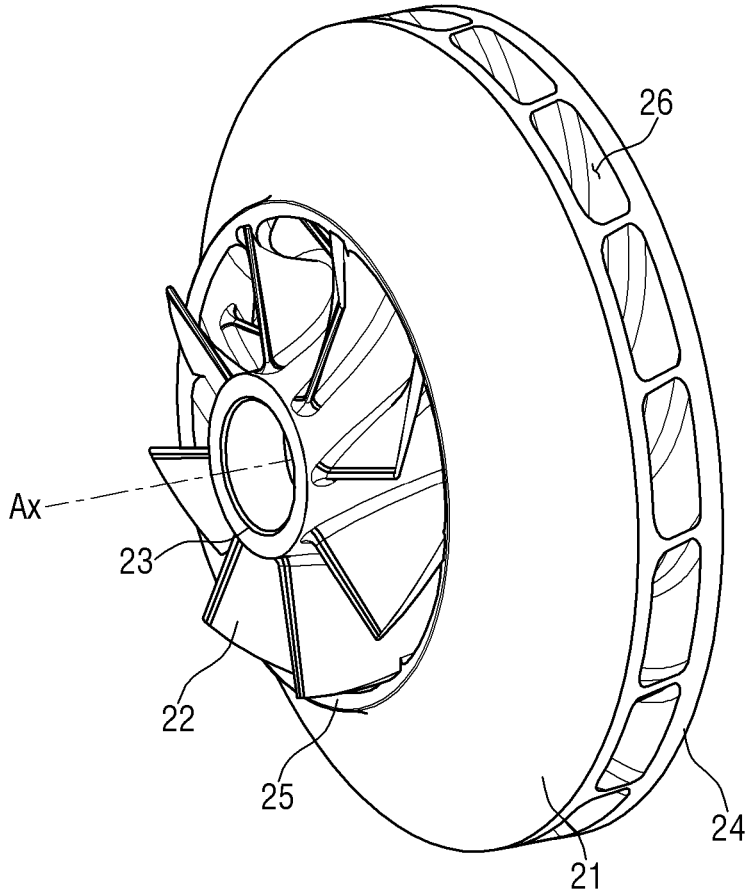
FIG. 3 is a perspective view an impeller body according to an exemplary embodiment.

The impeller body 2 is a closed impeller body having a plurality of blades 22 arranged at regular intervals along a circumference on a disk 24 and are covered by a shroud 21 (see FIG. 3). A through hole can be formed in a center portion 23 of the disk 24 constituting the impeller body 2 such that a shaft capable of rotating the impeller 1 around a rotation axis can be inserted into the through hole. A specific configuration of the impeller body 2 will be described with reference to FIG. 3.

The housing 3 allows for mechanical integration of components of a stage and accommodating the components therein. An opening open in a front to rear direction is formed at a center of the housing 3, and a part of the insert 4 and a part of the impeller body 2 are inserted in the opening to be accommodated in the housing 3. The insert 4 may be inserted in the housing 3, and may be engaged with the housing 3 using a fastening member. However, since the impeller body 2 has to be rotated, the impeller body 2 is not engaged with the housing 3 that does not rotate through the fastening member.

The directions in which the insert 4 and the impeller body 2 are inserted into the opening are opposite to each other, and thus the insert 4 and the impeller body 2 respectively enter inlets located in the directions opposite to each other. The entire flow path created by insert 4 is enclosed by the housing 3. The entire impeller body 2 must be contained within a pressure casing, but only an inlet 25 of the impeller body 2 is inserted below the circulation flow channel. Referring to FIG. 2, the housing 3 accommodates an eye seal 32 as a part of the housing 3 into which the insert 4 is coupled. The eye seal 32 is formed on one axial side of a first housing 31, and the impeller body 2 is inserted in the eye seal 32. This configuration is expressed such that a plurality of toric members are combined with one another, but the appearance of the housing 3 is not limited thereto.

The housing 3 may be fixed in combination with a scroll (not shown), a diffuser (not shown), or a gear box (not shown) of a centrifugal compressor in which the impeller 1 according to the above exemplary embodiments can be used. However, in these exemplary embodiments, compressor components other than the impeller 1 engaged to the housing 3 are not shown.

The insert 4 is a component that is inserted into the housing 3 to form a flow channel for a casing treatment of the impeller 1. The insert 4 is inserted into the housing 3 to be engaged with the housing 3 but does not rotate together with the housing 3.

A discharge port 422 of the insert 4 is located in a direction in which the insert 4 is inserted into the housing 3, and a part of the insert 4 where the discharge port 422 is located is inserted into the opening of the housing 3 prior to the other part of insert 4 is inserted. The discharge port 422 may partially accommodate the impeller body inlet 25 as described later with reference to FIG. 6.

An inflow channel 42 opened in the direction of a rotation axis is formed at the center of the insert 4. The inflow channel 42, which is a through hole through which a fluid can pass, allows the fluid introduced into the impeller body 2 to pass and reach the impeller body inlet 25. The inflow channel 42 may be formed at the center of the insert 4 in a circular shape, but may also be formed in an annular shape to prevent the fluid from flowing to the center. As described above, one end of the inflow channel 42 serves as the discharge port 422, and the other end thereof serves as the inlet port 421.

The inlet port 421 is located on the insert 4 in the direction opposite to the discharge port 422. The inlet port 421 is located far from the impeller body 2 on the rotation axis of the impeller 1, compared to the discharge port 422. A fluid flow is formed such that a fluid is introduced into the inlet port 421, passes through the inflow channel 42, and is discharged to the impeller body 2 through the discharge port 422.

The inlet port 421 may be formed in a base 41 included in the insert 4 of the impeller 1. The base 41 is a component that becomes a frame on which the components of the insert 4 are placed. Referring to FIG. 1, the base 41 is not inserted into the housing 3, is composed of an annular member having a diameter corresponding to the diameter of the housing 3 to include the inlet port 421 at the center thereof, and is engaged with the housing 3 using a fastening member such as a screw or a bolt. However, the shape of the base 41 is not limited thereto.

Since the inflow channel 42 is formed at the center of the insert 4, the insert 4 may be formed in a shape of a rotating body that surrounds the entire inflow channel 42, as illustrated in FIG. 1.

Other configurations of the insert 4 will be described with reference to FIGS. 4, 5 and 6.

FIG. 3 is a perspective view of an impeller body 2 according to an exemplary embodiment.

Referring to FIG. 3, the impeller body 2 according to this exemplary embodiment includes a disk 24, a plurality of blades 22, a central portion 23 of the disk 24, and a shroud 21.

The disk 24 included in the impeller body 2 is a component serving as a frame in which components of the impeller 1 are placed, and may have a disc shape.

The impeller body 2 is made of a material having adequate strength to resist a high stress that develops during operation. The material of the impeller body 2 may be a metal, including stainless steel, titanium or high nickel alloys, but is not limited thereto.

The disk center portion 23 extends along the rotation axis Ax of the impeller 1 extending in a direction orthogonal to a plate body, and have a through hole formed therein to allow a shaft (not shown) for rotating the impeller body 2 to be inserted without being slid. Since a general rotation shaft is formed in a cylindrical shape, the disk center portion 23 and the through hole into which the shaft is inserted may be formed in a cylindrical shape. The shaft is inserted into the through hole, and is connected to a driving unit of the compressor to receive a driving force, so as to rotate the impeller body 2 about the rotation axis Ax.

The blades 22 are placed on the disk 24. The blades 22 and the disk 24 may be attached together by, for example, welding, engaged by a screw, or integrally formed. However, the method of placing the blades 22 on the disk 24 and engaging the blades with the disk 24 is not limited thereto.

The blades 22 are arranged to surround the disk center portion 23. The blades 22 are arranged radially around the disk center portion 23 in a direction of an outer circumference of the disk 24, but is not disposed along a radius from the disk center portion 23 toward the outer circumference of the disk 24. Each of the blades 22 extends radially from the disk center portion 23 and curvedly extends in one direction rather than in the radial direction of the disk 24. Accordingly, the plurality of blades 22 are arranged in a shape bent in one direction from the disk center portion 23, and become a circle corresponding to the outer circumference of the disk 24 when the outermost end points of the plurality of blades 22 are connected.

The blades 22 extend from the disk 24 at a predetermined height along a direction parallel to the direction of the rotation axis Ax orthogonal to the disk 24. The blades 22 have a shorter length at a plane parallel to the disk 24 than at a portion close to the rotation axis Ax. Since the blades 22 extend in the direction of the rotation axis Ax to have a narrow width, the radius of a circle that can be made by connecting the outer end points of the blades 22 becomes narrow. Since the radius of the circle that can be made by connecting the outer end points of the blades 22 becomes narrow, an interval between the adjacent blades 22 also becomes narrow.

A fluid is externally introduced into the space between adjacent blades 22 at a position farthest from the disk 24 in the direction of the rotation axis Ax, and the introduced fluid is compressed by the rotation of the blades 22 due to the rotation of the impeller body 2 about the rotation axis Ax, and is discharged to the space between adjacent blades 22 at a position adjacent to the disk 24. The rotational energy of the impeller body 2 applied during the passage of the fluid between the blades 22 of the impeller body 2 is converted into the static and dynamic energy of the fluid when the fluid is discharged. Through such a process, the fluid introduced into the impeller body 2 is converted into a high-pressure fluid, and this high-pressure fluid is discharged.

The blades 22 are arranged symmetrically with respect to the disk center portion 23. The reason for this is that, since the blades 22 rotate about the rotation axis Ax, they cannot maintain uniform performance if they are not symmetrical.

The shroud 21, which is a component placed on an edge of each of the blades 22, covers the edge of each of the blades 22 such that the fluid does not flow out of the impeller body 2 while passing over the area between the edges of the blades 22. The space defined by the blades 22 and the shroud 21 and the disk center portion 23 is formed as a closed passage excluding the inlet and an impeller outlet 26 to allow the fluid to be completely discharged to a diffuser without leaking, so as to increase the operation efficiency of the impeller 1.

The shroud 21 covers the edges of the blades 22, and does not cover the blades 22 at one ends far from the disk 24 along the rotation axis Ax. Thus, a circular impeller body inlet 25 is formed. Since the impeller body 2 is inserted into the opening of the housing 3 from this inlet, the impeller body inlet 25 meets the discharge port 422 of the insert 4. That is, the component of the impeller 1 connected to the inflow channel 42 is the inlet of the impeller body 2. The fluid introduced through the inflow channel 42 is drawn into the impeller body 2 through the inlet 25 of the impeller body 2, compressed by the rotation of the impeller 1, discharged to the impeller outlet 26.

The compressed fluid is discharged to the impeller outlet 26 formed between the shroud 21 and the disk 24. The impeller outlet 26 may be formed as an opening that is open in the radial direction of the disk 24. The impeller outlet 26 is connected to a diffuser (not shown) to recover additional dynamic energy before discharging though a scroll (not shown).

The disk 24, blades 22, shroud 21 and disk center portion 23 of the closed impeller 1 according to the exemplary embodiments may be integrally formed, and may also be engaged through one or more fastening members.

Hereinafter, other configurations of the insert 4 will be described in detail with reference to FIGS. 4 and 5.

Figure 4:
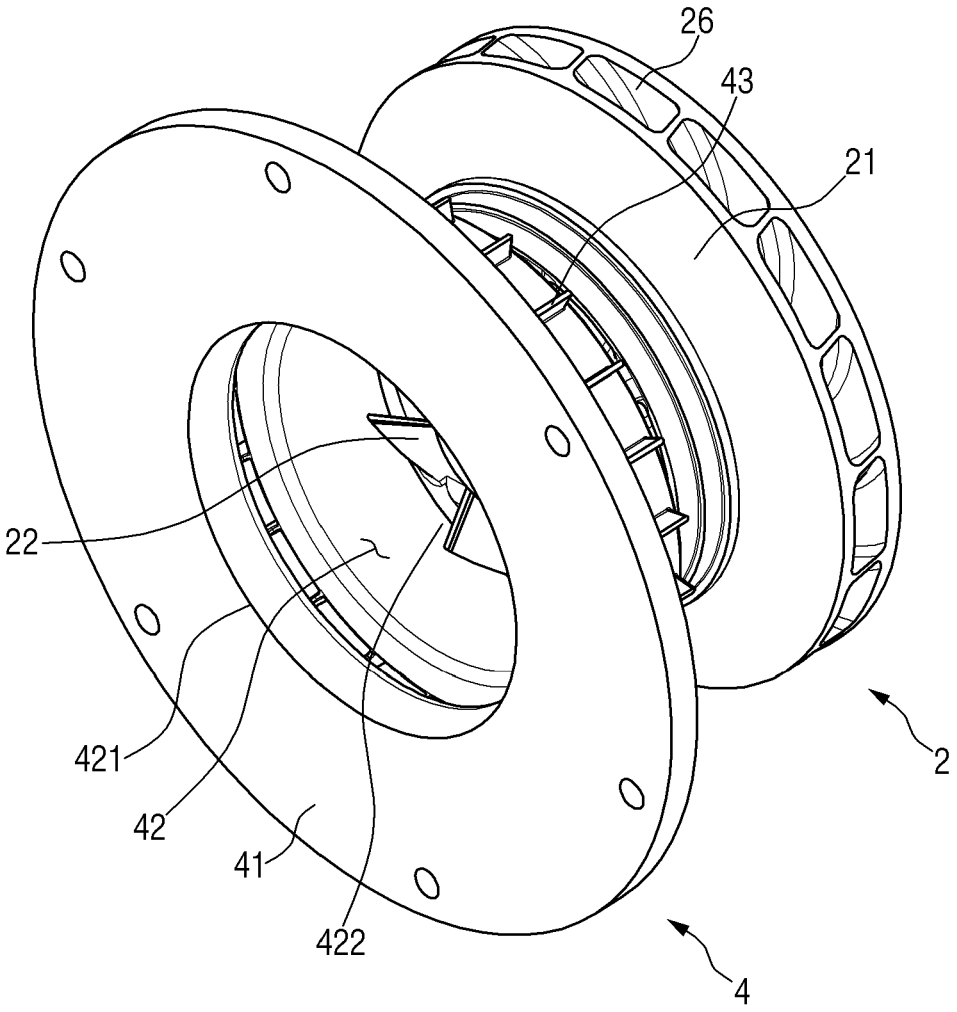
FIG. 4 is a perspective view of the impeller of FIG. 1 from which a housing was removed, according to an exemplary embodiment.
Figure 5:
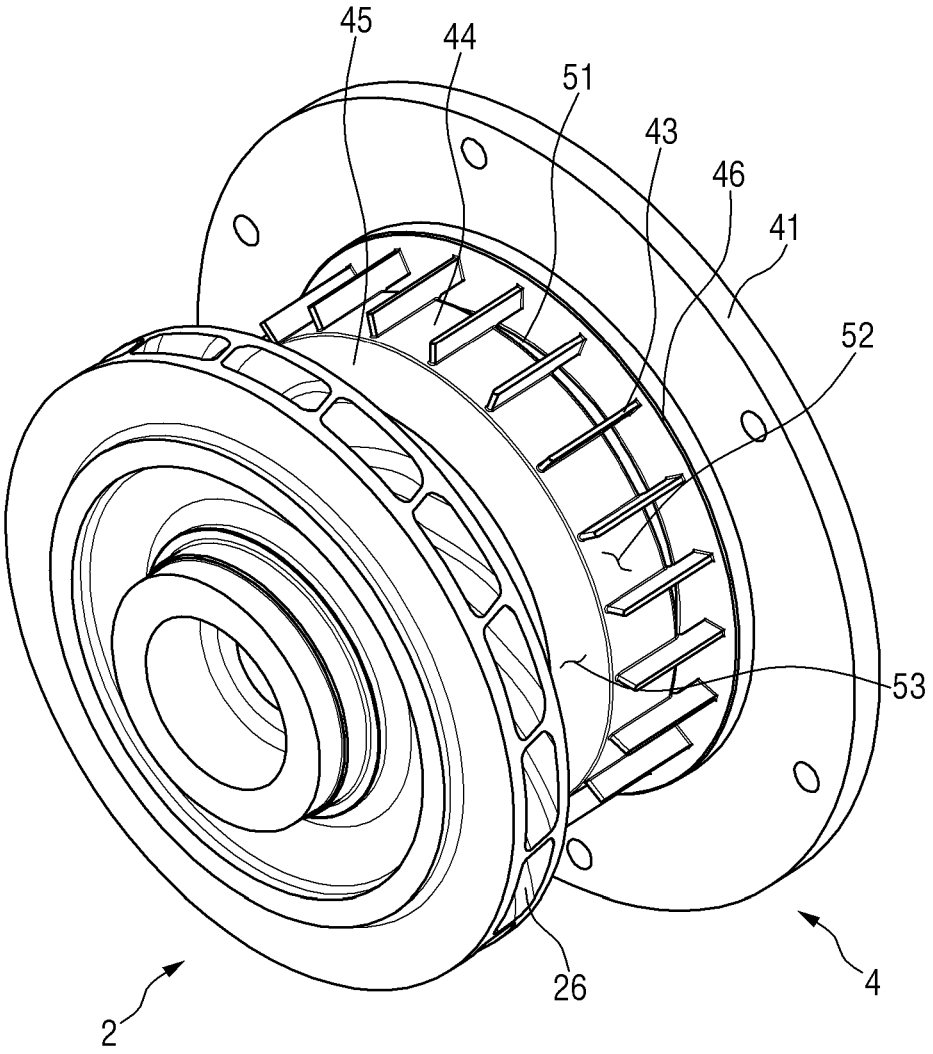
FIG. 5 is a perspective view of the impeller of FIG. 2 from which a housing was removed, according to an exemplary embodiment.

FIG. 4 is a perspective view of the impeller 1 of FIG. 1 from which the housing 3 was removed, according to an exemplary embodiment. FIG. 5 is a perspective view the impeller 1 of FIG. 2, from which the housing 3 was removed, according to an exemplary embodiment.

Since an insert body (44, 45) extending from the base 41 of the insert 4 along the direction of the rotational axis is a component constituting the rest portion of the insert 4 except the base 41, it is formed in the form of a rotating body having the inflow channel 42 at the center thereof. Further, the insert body (44, 45) has a tapered shape in which an outer side surface thereof extends along the rotation axis direction and the diameter of the section thereof decreases from a predetermined position. Therefore, the insert body (44, 45) includes a cylindrical portion 44 extending along the rotation axis and a tapered portion 45 tapered along the rotation axis. Although will be described later, the cylindrical portion 44 forms a hollow 52 between the cylindrical portion 44 and the housing 3, and the tapered portion 45 forms an outflow channel 53 between the tapered portion 45 and the housing 3.

A plurality of vanes 43 are arranged at predetermined intervals along an outer circumferential surface of the cylindrical portion 44. The predetermined intervals may be equal to one another, but are not limited thereto.

The vane 43 may extend from the base 41 along the outer circumferential surface of the cylindrical portion 44. As will be later, the vane 43 may be disposed at a clearance between the housing 3 and the cylindrical portion 44, and may have a width equal to the width of the clearance. The vane 43 may extend along a direction parallel to the rotation axis Ax (FIG. 3) on the outer circumferential surface of the cylindrical portion 44, and may extend in the radial direction of the cylindrical portion 44, but may be formed obliquely according to the design. Further, the vane 43 may be formed in a camber structure which is curved along the outer circumferential direction of the insert 4. Various forms of the vane 43 and the hollow 52 will be described later with reference to FIGS. 9 to 13.

When a fluid is introduced through the clearance formed between the cylindrical portion 44 and the housing 3, the vane serves to hinder the flow of the fluid so as to prevent swirl from occurring, and serves to convert a turbulent flow into a laminar flow. Therefore, the vane 43 may be formed in various forms according to the design.

There is a predetermined clearance between the insert body (44, 45) and the base 41, and the insert body (44, 45) and the base 41 may be connected through a connection portion formed at a predetermined interval in the clearance. The insert body (44, 45) and the base 41 may also be connected by the aforementioned vane 43. As will be later with reference to FIG. 6, the clearance becomes a reflow channel 51. The base 41 is provided with a base protrusion 46 protruding from the base 41 in the axial direction, so that the vane 43 extends from the base protrusion 46. The base protrusion 46, which may be formed to have a smaller diameter than the base 41, may be a stop when the insert 4 is inserted into the housing 3.

Hereinafter, the configuration of a recirculation flow channel (51, 52, 53) will be described in detail with reference to FIG. 6.

Figure 6:
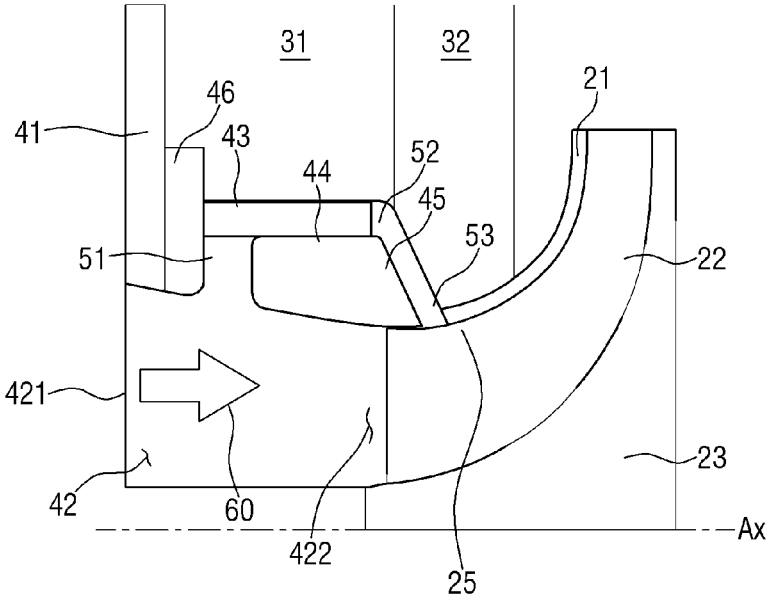
FIG. 6 is a side sectional view of the impeller of FIG. 1, according to an exemplary embodiment.

FIG. 6 is a side sectional view of the impeller 1 of FIG. 1 according to an exemplary embodiment.

As described above, the insert 4 is inserted into the housing 3, and the outer side surface of the insert body (44, 45) and the housing 3 are disposed at a predetermined clearance without contacting each other. The base 41 of the insert 4 and the housing 3 are engaged with each other such that the insert 4 is fixed with respect to the housing 3 without the insert body (44, 45) and the housing 3 being engaged with each other.

When the insert body (44, 45) and the housing 3 are disposed at a predetermined clearance, a flow channel through which the fluid flows is formed between the insert body (44, 45) and the housing 3. Further, since the insert 4 is provided with flow channels through which the fluid freely flows in and out due to the clearance between the insert body (44, 45) and the base 41, the recirculation flow channel (51, 52, 53) is formed in the impeller 1 by integrating the above flow channels. That is, the housing 3 and the insert 4 are engaged with each other at a predetermined clearance to be brought into contact with the impeller body 2, thereby forming a recirculation casing for the closed impeller body 2.

Since the recirculation flow channel (51, 52, 53) is connected with the inflow channel 42 at the discharge port 422 which is one end of the inflow channel 42 meeting the impeller body inlet 25 and the inlet port 421 which is the other end of the inflow channel 42, the fluid discharged from the inflow channel 42 may flow inwards, and the recirculation flow channel (51, 52, 53) may be configured to include an outflow channel 53, a hollow 52, and a reflow channel 51.

Referring to FIG. 6, it can be ascertained that an opening is formed between the housing 3 and the insert body (44, 45) in the impeller body inlet 25, and a flow channel is formed between the housing 3 and the tapered portion 45 of the insert body (44, 45) in a direction connecting the opening and the hollow 52. The diameter of an inner surface of the housing 3 adjacent to an outer surface of the tapered portion 45 is reduced toward the impeller body inlet 25, so that a flow channel having a uniform width is formed. This flow channel becomes the outflow channel 53.

Since the outflow channel 53 is formed along the tapered portion 45, it may be formed at an oblique angle with respect to the rotation axis Ax of the impeller 1. Thus, a part of the fluid flow naturally flows out from the inflow channel 42. Further, the outflow channel 53 may be formed in a tapered shape in which the width of the outflow channel 53 increases from the impeller body inlet 25 to the position connected to the hollow 52. Since the fluid flowing out from the outflow channel 53 has relatively higher pressure than the fluid in the recirculation flow channel (51, 52, 53), the pressure of the fluid flowing through the outflow channel 53 is lowered.

The fluid existing in a region around the impeller body inlet 25 may flow into the impeller body inlet 25 through the outflow channel 53, and, conversely, the fluid coming from the hollow 52 through the outflow channel 53 may be discharged to the region around the impeller body inlet 25.

The hollow 52 is a flow channel formed by the clearance between the cylindrical portion 44 and the housing 3. Therefore, the hollow 52 may be formed in the shape of a toric body surrounding the outer circumferential surface of the cylindrical portion 44 of the insert 4.

The width of the hollow 52 may be greater than the width of the outflow channel 53. As described above, the reason for this is that the fluid passing through the outflow channel 53 advances with the pressure lowered by the outflow channel 53, and thus the lowered pressure is maintained.

As described above, the vane 43 is located in the hollow 52. Thus, the vane 43 extends in a direction parallel to the flow direction of the fluid passing through the hollow 52. One end of the vane 43 is connected with the outflow channel 53, and the other end thereof is connected with the reflow channel 51. Therefore, the hollow 52 serves as an intermediate passage through which the flow of the fluid moving in each direction occurs in the recirculation flow channel (51, 52, 53), and serves to convert a turbulent flow into a laminar flow.

The reflow channel 51 is a flow channel formed by the clearance between the insert body (44, 45) and the base 41. The reflow channel 51 may be connected to the hollow 52 at one end, and may be connected to a portion of the inflow channel 42 at the other end. Here, the portion may be a region adjacent to the inlet port 421. Since the reflow channel 51 is a clearance between the insert body (44, 45) and the base 41, the reflow channel 51 may be formed to extend in the radial direction of the insert 4.

The fluid may flow into the hollow 52 through the reflow channel 51, and, conversely, the fluid may flow from the hollow 52 through the reflow channel 51 to the inflow channel 42.

Although it is shown in FIG. 6 that the orientation angle of each flow channel at the boundary of each flow channel is discontinuously bent, according to an exemplary embodiment, a curved recirculation flow channel (51, 52, 53) having curved edges may be formed by continuously changing the orientation angle of each flow channel.

Referring to FIG. 6, a flow 60 through which a fluid flows from the inlet port 421 toward the discharge port 422 through the inflow channel 42 is indicated by an arrow. The fluid having passed through the inflow channel 42 and arrived at the impeller body inlet 25 is drawn into the impeller 1, and compressed by the rotation of the blades 22 to be discharged to the impeller outlet 26. In this case, the housing 3 and the insert 4 are fixed.

Hereinafter, the fluid flow when a fluid flows at a low flow rate (61, 63, 64, 65) or a high flow rate flow (66, 67, 68, 69) will be described through the side sectional view of the impeller 1 of FIG. 1 with reference to FIGS. 7 and 8.

Figure 7:
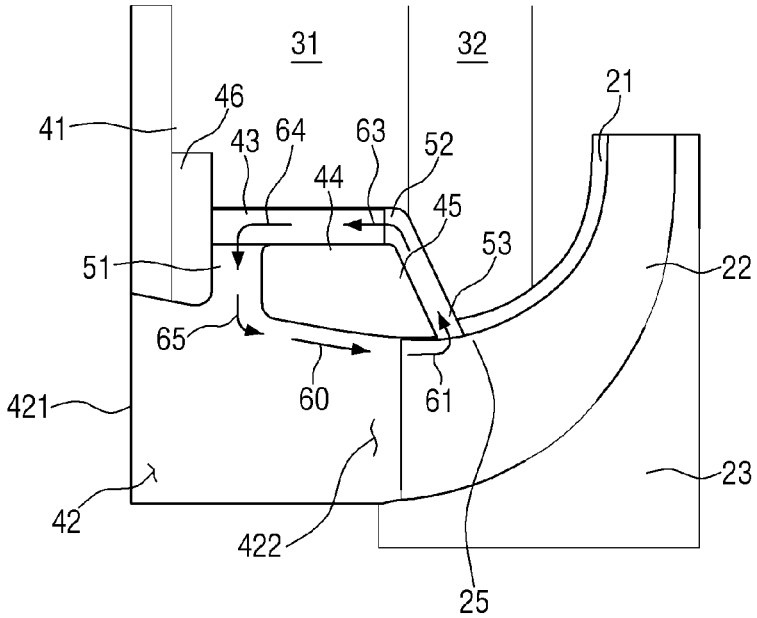
FIG. 7 is a side sectional view showing a direction of a fluid flow through a circulation flow channel at a low flow rate in the impeller of FIG. 1, according to an exemplary embodiment.

FIG. 7 is a side sectional view showing a fluid flow when a fluid flows at a low flow rate (61, 63, 64, 65) in the impeller 1 of FIG. 1 according to an exemplary embodiment.

Referring to FIG. 7, the fluid flow in the recirculation flow channel (51, 52, 53) in a case where a fluid flows into the inflow channel 42 of the impeller 1 at a low flow rate (61, 63, 64, 65) may be observed in a direction of an arrow shown therein.

When the fluid flow at a low flow rate (61, 63, 64, 65) is formed in the region of the impeller body inlet 25, a flow rate of the fluid 60 introduced into the impeller body 2 is insufficient compared to the rotation of the impeller body 2, so that the impeller body 2 excessively rotates. Therefore, the impeller body 2 generates large noise and vibration, and suffers a stall phenomenon in which the fluid cannot be normally compressed and discharged.

Accordingly, a part of the fluid flows out from the region adjacent to the impeller body inlet 25 to the outflow channel 53, and the outflowed fluid 61 flows along the outflow channel 53 to be introduced into the hollow 52. The fluid 63 introduced into the hollow 52 is rectified by the vane 43, passes through the hollow 52 and the reflow channel 51, and is reintroduced into the inflow channel 42. The reintroduced fluid 65 and the newly introduced fluid having reached the impeller body inlet 25 through the inflow channel 42 may form a flow rate suitable for the operation of the impeller body 2, so that the impeller body 2 normally operates and does not stall. Through this process, a normal operation region can be ensured in the fluid flow at the low flow rate (61, 63, 64, 65).

Figure 8:
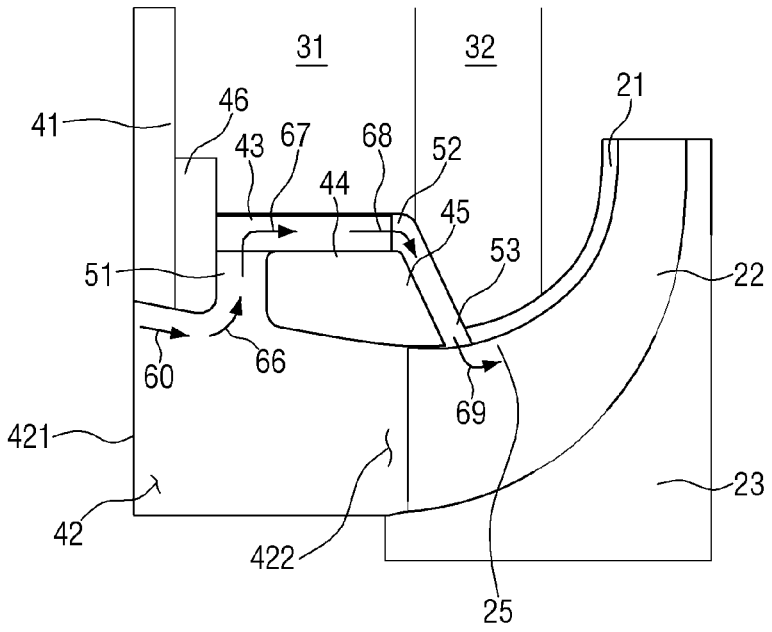
FIG. 8 is a side sectional view showing a direction of a fluid flow through a circulation flow channel at a high flow rate in the impeller of FIG. 1, according to an exemplary embodiment.

FIG. 8 is a side sectional view showing a fluid flow when a fluid flows at a high flow rate (66, 67, 68, 69) in the impeller 1 of FIG. 1 according to an exemplary embodiment.

Referring to FIG. 8, the fluid flow in the circulation flow channel (51, 52, 53) in the case where a fluid flows into the inflow channel 42 of the impeller 1 at the high flow rate (66, 67, 68, 69) may be observed in the direction of the arrow.

When the fluid flow at the high flow rate (66, 67, 68, 69) is formed in the impeller body inlet 25, the flow rate of the fluid 60 introduced into the impeller body 2 is excessive compared to the rotation of the impeller body 2, so as to cause a choking phenomenon in which the impeller body 2 does not rotates smoothly.

Accordingly, a part of the fluid having an excessively high flow rate (66, 67, 68, 69) flows out through the reflow channel 51, and the outflowed fluid 66 is introduced into the hollow 52 connected to the reflow channel 51. The fluid having passed through the hollow is introduced into the outflow channel 53 connected to the hollow 52, and is discharged to the region adjacent to the impeller body inlet 25 through the outflow channel 53. That is, a part of the fluid having the high flow rate (66, 67, 68, 69) is bypassed through the circulation flow channel (51, 52, 53) to be introduced into the impeller 1. The bypassed fluid and a newly introduced fluid having reached the impeller body inlet 25 through the inflow channel 42 may form a flow rate suitable for the operation of the impeller body 2, so that the impeller body 2 normally operates and does not choke. Through this process, a normal operation region can be ensured in the fluid flow at the high flow rate (66, 67, 68, 69).

Accordingly, referring to FIGS. 7 and 8, the circulation flow channel (51, 52, 53) is formed through casings such as the housing 3 and the insert 4 to control the flow rate of a introduced fluid without supplying power, so as to obtain an effect of ensuring a wider range of normal operation of the closed impeller 1. That is, the recirculation casing formed by the housing 3 and the insert 4 becomes a self-recirculation casing.

Hereinafter, various forms of the vane 43 and the hollow 52 according to exemplary embodiments will be described with reference to FIGS. 9 to 13.

Figure 9:
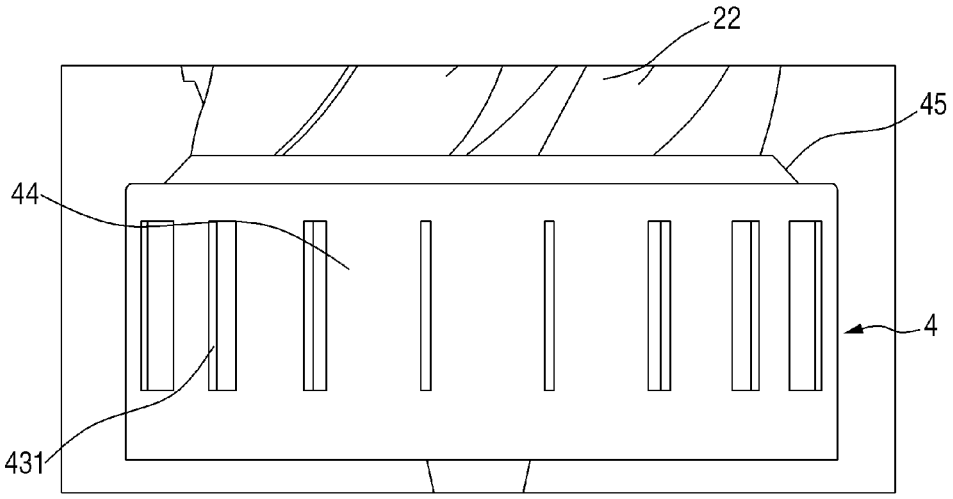
FIG. 9 is a plan view of a straight vane according to an exemplary embodiment.

FIG. 9 is a plan view of a straight vane 431 according to an exemplary embodiment.

The vane 431 shown in FIG. 9, similarly to the shape of the vane 43 described in FIGS. 3 and 4, may extend toward the tapered portion 45 adjacent to the blades 22 in a direction parallel to the rotation axis Ax in the cylindrical portion 44. The plurality of vanes 431 may be arranged at regular intervals along the outer circumferential surface of the cylindrical portion 44. However, as represented in FIGS. 3 and 4, the vane 431 may be formed so as to occupy only a part of the region without extending over the whole height of the cylindrical portion 44.

Figure 10:
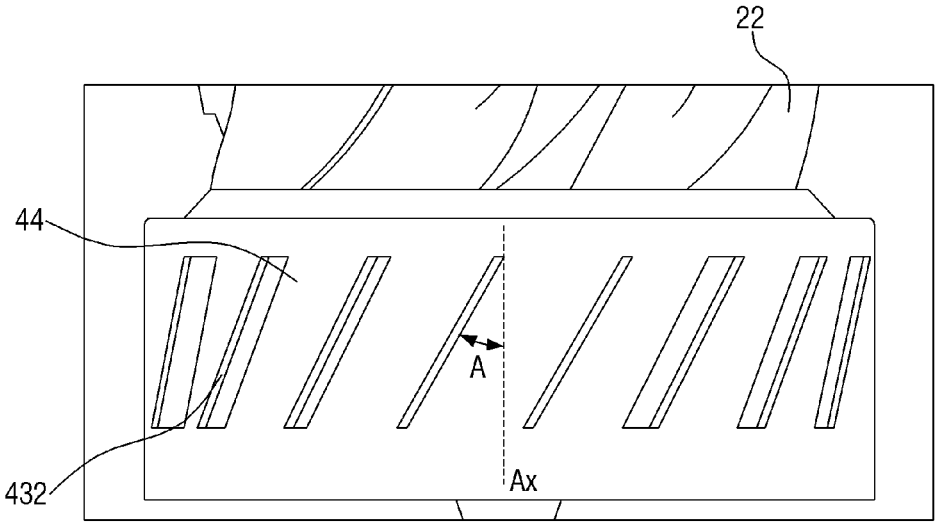
FIG. 10 is a plan view of an oblique vane according to an exemplary embodiment.

FIG. 10 is a plan view of an oblique vane 432 according to an exemplary embodiment.

The vane 432 shown in FIG. 10 obliquely extends from the outer circumferential surface of the cylindrical portion 44 in a direction not parallel to the rotation axis Ax of the impeller 1. The plurality of vanes 432 may be formed such that the angle A between each vane 432 and the rotation axis Ax is constant. Although it is shown in FIG. 10 that the angle A between the vane 432 and the rotation axis Ax is 30°, this angle A is not limited thereto.

The direction in which the vane 432 is inclined is preferably, but not necessarily, a direction in which the impeller 1 rotates. The reason for this is that, since the fluid receiving the kinetic energy due to the rotation of the impeller 1 is introduced into the space between the cylindrical portion 44 and the vane 432, and still has a rotational motion component, the orientation of the vanes is determined in parallel to the flow direction of the fluid, and thus the fluid may be reintroduced without the flow of the fluid being unduly disturbed.

Figure 11:
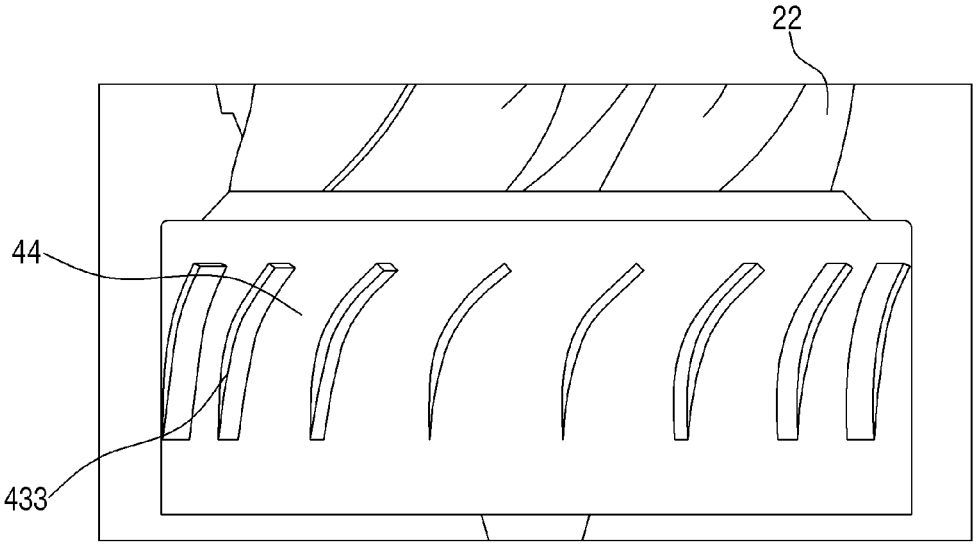
FIG. 11 is a plan view a camber-shaped vane according to an exemplary embodiment.

FIG. 11 is a plan view of a camber-shaped vane 433 according to a third embodiment.

The vane 433 shown in FIG. 11 extends in an oblique direction not parallel to the rotation axis Ax in the region adjacent to the blade 22, and is curved in one direction. That is, the vane 433 is formed in a camber structure. When the vane 433 is formed in a camber structure, similarly to the case of using the inclined vane 432 in this exemplary embodiment, the vane 433 can receive the introduced fluid without undue disturbance. However, since the vane 433 has a structure curved in a direction parallel to the rotation axis Ax at a position distant from the blade 22, there may be an effect that the fluid passing between the cylindrical portion 44 and the vane 433 proceeds in a direction parallel to the rotation axis Ax.

Figure 12:
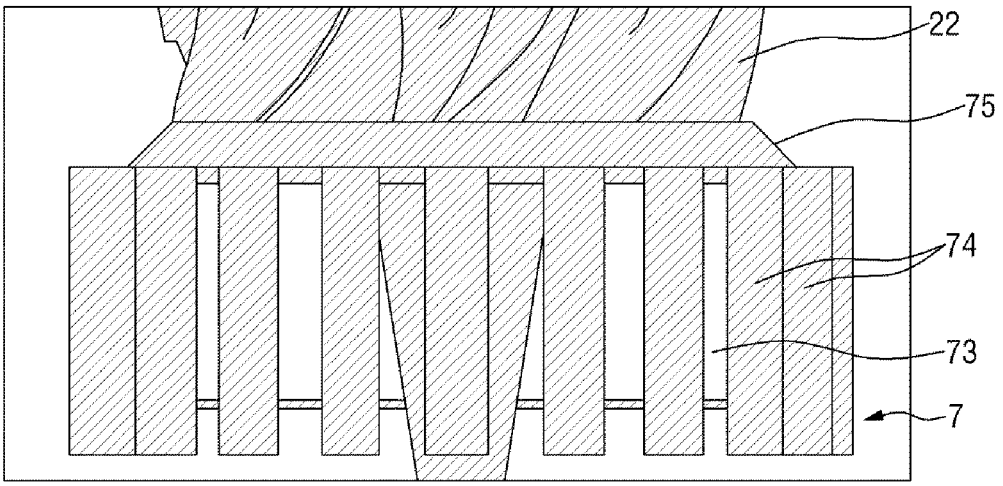
FIG. 12 is a plan view showing a cavity type insert according to an exemplary embodiment.

FIG. 12 is a plan view showing a cavity type insert according to an exemplary embodiment.

The cylindrical portion 74 of the insert 4 shown in FIG. 12 is not provided with vanes, but provided with a plurality of cavities 73 formed to penetrate the cylindrical portion 74 in a radial direction of the insert 4. Therefore, the outflowed fluid may be returned to the inflow channel 42 through the plurality of cavities 73 formed in the cylindrical portion 74. In this case, the passages through which the fluid recirculates become various.

Figure 13:
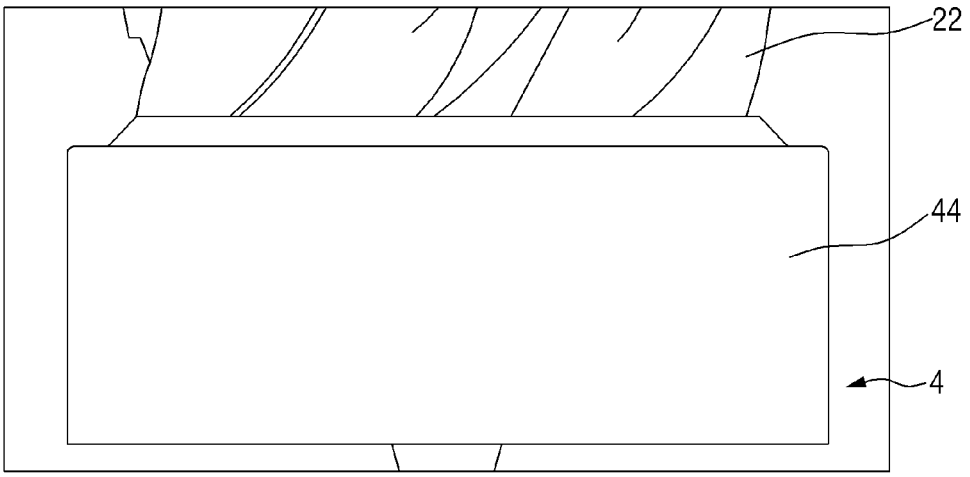
FIG. 13 is a plan view showing a hollow without a vane according to an exemplary embodiment.

FIG. 13 is a plan view of a hollow without a vane according to an exemplary embodiment.

The insert 4 shown in FIG. 13 is not provided with a vane. Therefore, the fluid can pass through the hollow 52 without resistance of the vane.

As described above, according to the exemplary embodiments, the effects thereof are as follows.

It is possible to enlarge the stable operation range of the shrouded centrifugal compressor by incorporating self-recirculation casing into the closed impeller.

It will be understood by those skilled in the art that the exemplary embodiments may be embodied in other specific forms without departing from the technical idea or essential characteristics of the inventive concept. It is therefore to be understood that the exemplary embodiments described above are illustrative in all aspects and not restrictive. The scope of the inventive concept is defined by the appended claims rather than the detailed description of the exemplary embodiments, and all changes or modifications derived from the meaning and scope of the claims and their equivalents are to be construed as being included within the scope of the inventive concept.

Although some exemplary embodiments have been disclosed for illustrative purposes, those skilled in the art will appreciate that various modifications, additions and substitutions are possible, without departing from the scope and spirit of the inventive concept as disclosed in the accompanying claims.

What is claimed is:

1. A closed impeller comprising:

a housing provided with an opening;

an insert inserted into one side of the opening; and an impeller body inserted into the other side of the opening, and comprising:

a plurality of blades;

a shroud covering the plurality of blades;

an inlet provided within the housing; and an impeller outlet provided at an exterior of the housing to be exposed from the housing, wherein the insert is provided with an inflow channel guiding a fluid into the inlet of the impeller body, wherein a clearance is disposed between an outer surface of the insert and an inner surface of the housing such that the outer surface of the insert and the inner surface of the housing do not contact each other, and the clearance forms a circulation flow channel connecting a first end of the inflow channel with a portion where a second end opposite to the first end of the inflow channel meets the inlet of the impeller body, wherein the impeller outlet is disposed further in a first direction parallel to a rotation axis of the impeller than a furthest end of the housing in the first direction parallel to the rotation axis, wherein the insert comprises a plurality of vanes formed in a hollow of the circulation flow channel and the plurality of vanes are inclined in a second direction in which the impeller rotates, wherein the housing comprises a housing body and an eye seal, provided on a side of the housing body in the first direction, and wherein a portion of the shroud is within the eye seal of the impeller body, and another portion of the shroud is exposed from the eye seal in the first direction.

2. The closed impeller of claim 1, wherein the circulation flow channel comprises:

an outflow channel configured to receive the fluid discharged from the inlet of the impeller body;

the hollow, wherein the hollow is connected with the outflow channel to pass the fluid; and a reflow channel of which a third end is connected with the hollow and a fourth end opposite to the third end is connected with the first end of the inflow channel so as to introduce the fluid into the inflow channel.

3. The closed impeller of claim 2, wherein the plurality of vanes are formed in a camber structure which is bent toward a radial direction of the insert along an outer circumferential direction of the insert.

4. The closed impeller of claim 2, wherein the plurality of vanes are arranged at regular intervals along an outer circumferential direction of the insert.

5. The closed impeller of claim 2, wherein the plurality of vanes are disposed to remove a swirl of the fluid passing through the hollow.

6. The closed impeller of claim 2, wherein the outflow channel has a width which is wider from the inlet of the impeller body toward the hollow.

7. The closed impeller of claim 2, wherein a width of the hollow is greater than a width of the outflow channel.

8. The closed impeller of claim 2, wherein the reflow channel extends along a radial direction of the insert.

9. The closed impeller of claim 2, wherein the hollow is formed in a shape of a toric body surrounding an outer circumference of the insert.

10. The closed impeller of claim 2, wherein a part of the insert forming the outflow channel and a part of the housing are formed such that at least one of a diameter of the insert and a diameter of the housing becomes smaller as the insert and the housing approach the inlet of the impeller body.

11. The closed impeller of claim 2, wherein, when a flow rate of the fluid guided into the inflow channel is low, a part of the fluid is discharged from a region adjacent to the inlet of the impeller body to the outflow channel, is circulated through the hollow and the reflow channel, and is introduced into the inflow channel.

12. The closed impeller of claim 2, wherein, when a flow rate of the fluid guided into the inflow channel is high, a part of the fluid is discharged to the reflow channel, is bypassed through the hollow and the outflow channel, and is introduced into a region adjacent to the inlet of the impeller body.

13. The closed impeller of claim 1, wherein the outer surface of the insert forming the circulation flow channel has a curved edge.

14. The closed impeller of claim 1, wherein the inflow channel is formed at a center of the insert in a circular shape.

15. The closed impeller of claim 1, wherein the inflow channel is formed at a center of the insert in an annular shape.

16. The closed impeller of claim 2, wherein the plurality of vanes extend in a direction oblique to the rotation axis of the impeller.

17. The closed impeller of claim 2, wherein the insert has a plurality of cavities formed in a radial direction of the insert so as to connect the hollow and the inflow channel.

18. The closed impeller of claim 2, wherein the outflow channel has a width which is wider from the inlet of the impeller body toward the hollow, wherein the width of the hollow is greater than the width of the outflow channel, and wherein the reflow channel extends along a radial direction of the insert.

* * * * *